United States Patent [19]

Risi

[11] 4,190,244

[45] Feb. 26, 1980

[54] DEVICE FOR PICKING UP SHEETS FROM A MAGAZINE IN A PACKAGING MACHINE

[76] Inventor: Roberto Risi, Via Zampieri 11, Casalecchio di Reno (Province di Bologna), Italy

[21] Appl. No.: 878,129

[22] Filed: Feb. 15, 1978

[30] Foreign Application Priority Data

Feb. 18, 1977 [IT] Italy ..... 3356 A/77

[51] Int. Cl.[2] ..... B65H 3/20

[52] U.S. Cl. ..... 271/33; 156/568; 156/571; 156/DIG. 30

[58] Field of Search ..... 271/33, 18, 109, 112, 271/113, 114, 115, 119, 120; 156/568, 571, DIG. 29, DIG. 30, DIG. 32, DIG. 31

[56] References Cited

U.S. PATENT DOCUMENTS

| | | | |
|---|---|---|---|
| 3,591,168 | 7/1971 | Zodrow | 271/33 X |
| 3,723,228 | 3/1973 | Schaltegger | 156/568 |
| 4,077,621 | 3/1978 | Knuppertz | 271/33 |

*Primary Examiner*—Richard A. Schacher

*Attorney, Agent, or Firm*—Albert Josif; Guido Modiano

[57] ABSTRACT

A device for picking up sheets from a magazine in a packaging machine comprises a driving shaft pivotally supporting a plurality of oscillating levers each comprising a cylindrical segment having grippers for picking up the sheets. A plurality of cams are moreover provided for actuating the oscillating levers to cause the cylindrical segments to roll without slippage for a fraction of a turn of the driving shaft to pick up the leading sheet in the magazine.

2 Claims, 2 Drawing Figures

DEVICE FOR PICKING UP SHEETS FROM A MAGAZINE IN A PACKAGING MACHINE

BACKGROUND OF THE INVENTION

This invention relates to a device for picking up sheets from a magazine in a packaging machine. The invention is useful for picking up labels in labelling machines.

Prior art labelling machines are substantially of two types, one with a movable label magazine, and one with a fixed or stationary label magazine. The device intended to pick up the labels from the magazine comprises generally a rotating drum, onto peripheral portions whereof a coating of glue is applied by means of suitable gumming rollers. If the magazine is of the movable type, the withdrawal is effected by imparting to that magazine an oscillatory movement such that each label adhere without slippage on a corresponding area of the drum provided with glue, to remain attached thereto. If, by contrast, the magazine is of the fixed type, then the withdrawal is carried out by means of circular sectors or segments, being controlled by camming means to first contact the gumming rollers and then roll over the labels removing them from the magazine which contains them.

Prior art labelling machines are generally affected by functional drawbacks of importance. Frequently, for example, there occurs a relative movement, i.e. slip, between the label magazine and the drum sector provided with glue, thereby the correct withdrawal of the labels may be precluded. In particular for the fixed drum machines, the arrangement of oscillable circular sectors on the drum poses a whole series of additional problems, among which the presence of high stresses in the overcoming of the dead centers by the camming means, as well as the forcibly limited number of circular sectors, i.e. labels on the drum, due to the large angular size of the latter.

SUMMARY OF THE INVENTION

It is a primary object of this invention to provide a device which obviates such drawbacks, and in particular provided with oscillable circular sectors exhibiting a minimum angular size.

This object is achieved by a device (according to the invention) for picking up sheets from a magazine in a packaging machine, characterized in that it comprises a driving shaft journalled in a base and continuously moving, a pair of plates keyed to said driving shaft, a plurality of oscillating members pivotally supported by said plates through lever means pivoted at locations angularly distributed along a circumference concentrical to said driving shaft, each said oscillating member comprising a cylindrical segment having sheet picking up means and a gear segment of equal radius of curvature, a stationary rack fixed in the proximity of the magazine and in the same plane as the leading sheet, cam control means formed in the base concentrically with said driving shaft for actuating the oscillating members such that the trailing edge of the cylindrical segments come into contact with the leading sheet of the magazine and the gear segments mesh with the rack, thereby the cylindrical segments roll, without slippage, for a fraction of turn of the driving shaft onto the leading sheet to pick it up.

BRIEF DESCRIPTION OF THE DRAWINGS

Further features of this invention will be apparent from the following detailed description of a preferred embodiment thereof, illustrated by way of example in the accompanying drawings, where.

DESCRIPTION OF THE PREFERRED EMBODIMENTS

Figure 1:
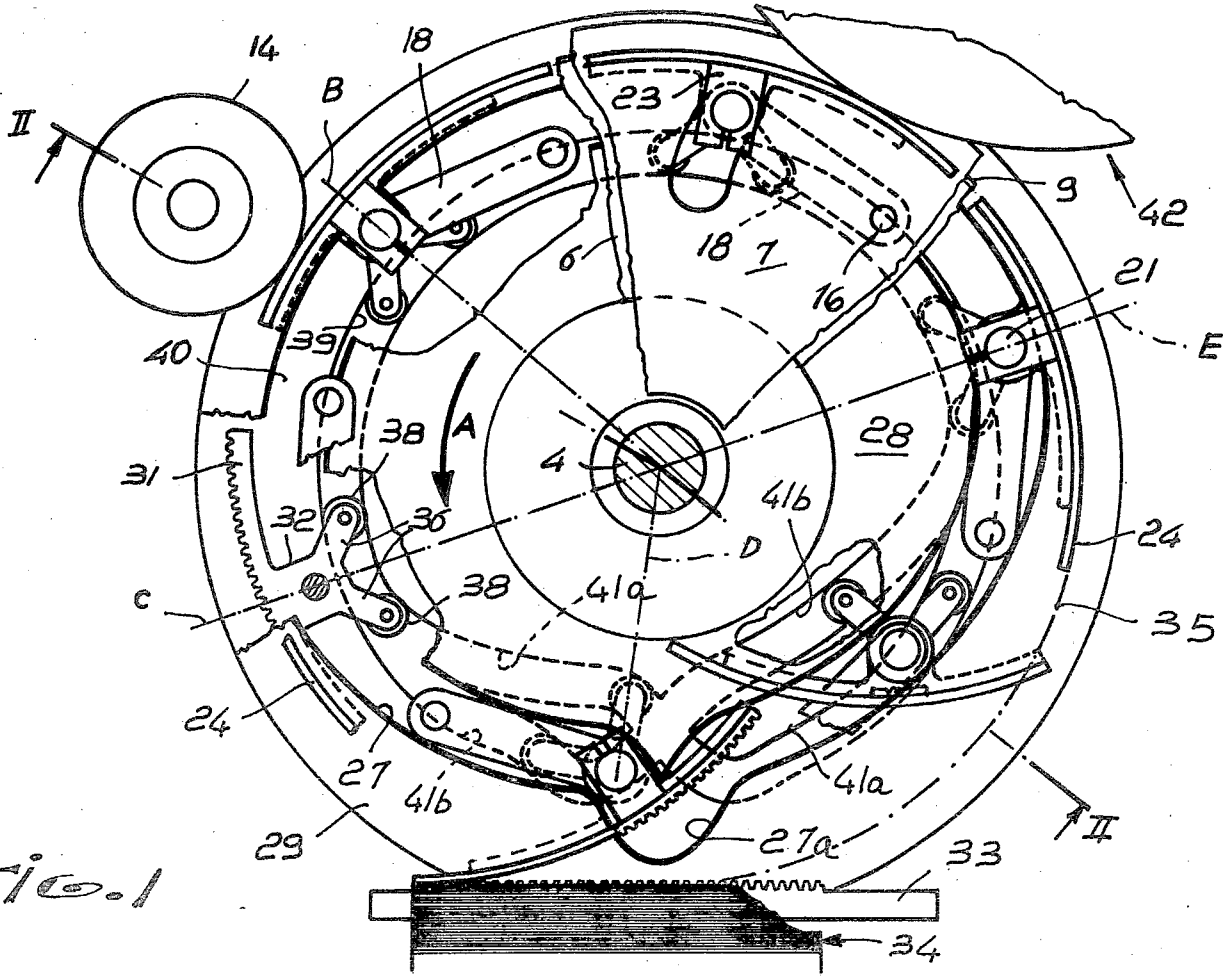
FIG. 1 is a plan view, partly schematic, of the instant device, along section lines at various levels.
Figure 2:
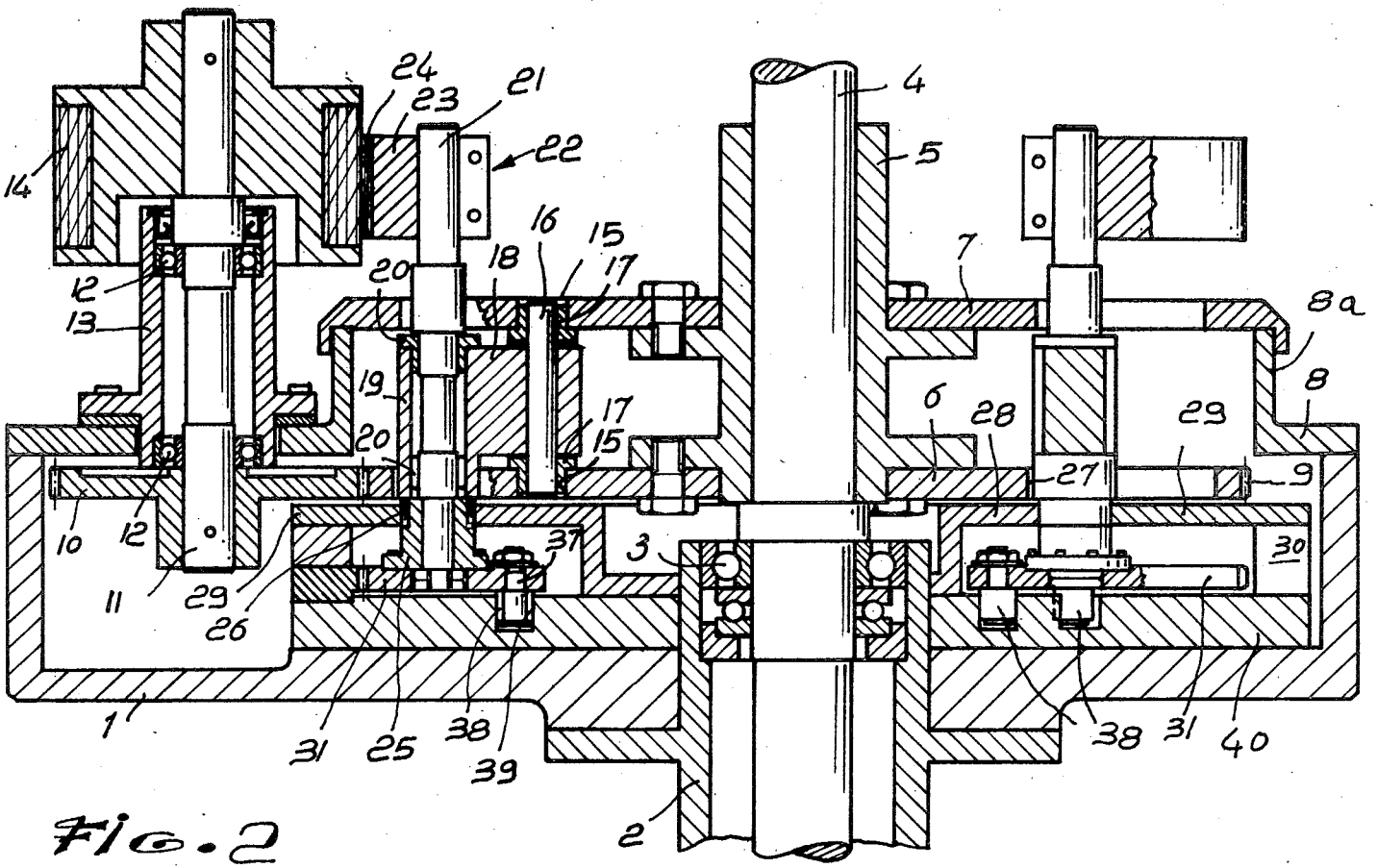
FIG. 2 is a sectional view taken along the plane II—II of FIG. 1.

With reference to such Figures, the instant device comprises a box-like base 1 of rather flattened shape, at the center whereof is a sleeve 2, wherewithin a vertical shaft 4 is journalled through bearings 3.

The shaft 4, below the box 1, is acted upon by driving members not shown in the drawings, which impart to that same shaft a rotation in the direction shown by the arrowhead A. Above the sleeve 2, there are coupled to the shaft 4, through a second sleeve 5, a first plate 6 and second plate 7, being horizontal and parallel to each other. The second plate 7, located above the first closes an opening defined by a cylindrical side 8*a* which raises from a plate 8, attached to the top portion of the box 1. The edge of the plate 7 is bent downwards externally to the upper edge of the side 8*a*.

The first plate 6 is provided peripherally with a gear ring 9 meshing with a gear wheel 10 connected to a shaft 11. Said shaft 11 is supported, through bearings 12, in a bushing 13 inserted into and secured to the plate 8, and carries above the latter a gumming roller 14 whereby, as explained hereinafter, glue is applied onto the label picking up members. In the plates 6,7 there are provided a plurality of holes 15 (in the embodiment shown, six in number), which are drilled symmetrically along a respective circumference, substantially intermediate to the radius dimension of the plates themselves, and distributed at equal angles to the center.

In each pair of coaxial holes 15 of the two plates 6 and 7 there are arranged respective pivot pins or shafts 16, carried by bushings 17, which shafts extend parallel to the central shaft 4. Each shaft 16 acts as the fulcrum for a lever arm 18 disposed between the plates 6 and 7 and pivotally engaged at one end in the central portion of said shafts 16. By contrast, at the other end, each lever arm 18 configurates a sleeve 19, with a vertical axis, wherein is in turn pivotally engaged, through bushings 20, a respective shaft 21 also having a vertical axis. The shafts 21 project downwards from the first plate 6 and upwards from the second plate 7, through suitable slotted holes formed in said plates. To the portion thereof which is located above the second plate 7, there is attached a withdrawal sector 22, configurated mushroom-like in a horizontal plane and comprising a certain radial arm 23, locked onto the shaft 21, and a cylindrical segment 24, the center of curvature whereof is located on the axis of the shaft 4 and is equal to the one of the gear ring 9. Said cylindrical segment 24 has a developed length and a height at least equal to the length and respectively height of the labels to be picked up. At the portion located below the first plate 6, the shaft 21 carries a further bushing 25, to the outer surface whereof is coupled a bearing 26. The bearing 26 is engaged in a groove 27 defined between the outer profile of an inner radial cam 28 and the inner profile of an outer radial cam 29 extending in the same plane as the cam 28. The cam 28 is affixed to the base 1 with the interposition of the plate 40, which will be referred to hereinafter, and has a profile which, as may be seen in FIG. 1, is for a greater angle than 180° circular with center on the axis of shaft 4, while the rest of the angle is shaped. The cam 29 circumscribes the cam 28 and is fixed to the same plate 40 with the interposition of blocks 30. The shaft 21 carries, at its lower end underlying the cam 28, a gear segment 31 attached to the shaft through a lug 32, which from the segment 31 projects inwardly.

The withdrawal sector 22 and the gear segment or toothed sector 31 form, together with the shaft 21, whereto they are mounted rigidly, a member which may be oscillated about the axis of the shaft 21 and is pivoted, through the lever arm 18, to the rotating drum constituted by the pair of plates 6 and 7. The gear segment 31 meshes with a stationary rack 33 rigid with a magazine 34 of sheets or labels. In particular, the magazine 34 is disposed such that the leading sheet or label therein is tangent to a circumference with radius equal to the distance between the axis of shaft 4 and the outer surface of the cylindrical segment 24. In FIG. 1, that circumference is indicated at 35 and shown with a dash-and-dot line. That same circumference 35, moreover, represents the pitch line of the gear between the gear segment 31 and rack 33, which is thus aligned in the same plane as said leading label of the magazine 34. By contrast, at the radially inner end, the radial arm 32 of the gear segment 31 bifurcates in a sort of "Y" to originate a pair of short arms 36. Each of such short arms 36 is crossed by a pin 37 carrying a bearing 38 below the short arms themselves. The bearings 38 are inserted inside a groove 39 of a second cam 40. The cam 40 is also a radial one and attached to the base 1 below the first cam 28.

As may be seen in FIG. 1, the profile of the groove 39 of the second cam 40, substantially semicircular over one half of its extension, bifuractes in to branches 41*a* and 41*b* at the magazine 34, which branches or legs cross each other shortly after the latter centerline, to then merge together in a single groove. In each of such legs 41*a* and 41*b* of groove 39 is inserted, with its respective bearing 38, one of the two pins 37 of each gear segment 31, such as to enable this gear segment 31 and the withdrawal segment 22 connected thereto to rotate about the axis of the shaft 21, thus allowing the cylindrical segment 24 to roll onto the leading one of the labels contained in the magazine 34. Correspondingly, the groove 27 defined between the cams 28,29 which guides the radial movements of the shaft 21, forms sort of an elbow 27*a* which brings the shaft 21 closer to the magazine 34, thus enabling the gear segment 31 to mesh with the rack 33 along the pitch line 35.

Downstream of the magazine 34, again in the direction of rotation A, there is located an assembly 42 which, in a known manner, is operative to separate the sheets or labels from the cylindrical segments 24. For example, the assembly 42 may comprise a carousel carrying peripherally arranged grippers controlled to grip the labels and release them onto the article to be labelled.

The device described in the foregoing operates as follows. The positions taken by the oscillating members comprising the withdrawal segment 22 and gear segment 31, mounted on the shaft 21, are assumed to be successive working positions taken by one only of such members, during one machine cycle. It is also assumed that movement starts from the position indicated at B, along the direction of rotation A, as shown in FIG. 1. In that position, the outer periphery of the cylindrical segment 24 and gear segment 31 extends along the same circumference concentrical with the rotation axis of shaft 4. While retaining that position, the cylindrical segment 24 moves past the gumming roller 14 which applies on the outer surface of the segment 24 a coating of an adhesive material. During the contact between the gumming roller 14 and cylindrical segment 24, the relative speed is zero, i.e. there occurs no slip, since the roller itself is driven through its gear wheel 10 by the ring gear 9 of the plate 6 which drives the cylindrical segment 24. After applying the film of glue, the oscillating member begins to lean forward, position C, owing to the special shape of the groove 39. In fact, the cam 29 urges the shaft 21 inwardly and forces the first leading one of the pins 37 to deviate inwards. At this point, when the first of such pins 37 is started along the innermost leg 41*a* of the cam 40, the shaft 21 is guided by the groove 27 such that the second pin 37 is started along the leg 41*b*, thus contributing to the rotation of the oscillating member about the axis of the shaft 21. As the oscillating member reaches the desired inclination, the shaft 21 moves into the elbow portion 27*a*, thus controlling the rear edge of the cylindrical segment 24 to approach the edge of the leading label in the magazine. Upon the cylindrical segment 24 contacting the label (position D), the gear segment 31 meshes with the rack 33. It should be noted that, owing to the special configuration of the legs 41*a* and 41*b*, the oscillating member is imparted rotation in the opposite direction to the previous one, thereby upon the gear segment 31 meshing with the rack 33, there occurs no relative speed between such two parts. The successive approaching and crossing of the legs 41*a* and 41*b* of the groove 39 of the second cam 40 enables the gear segment 31 to roll along the rack 33 wherewith it is in mesh engagement. Simultaneously, the cylindrical segment 24 of the withdrawal segment or sector 22, by rolling over the leading label in the magazine 34, allows the label to separate, which remains attached to the outer surface of the segment 24, to receive glue therefrom. On completion of the label withdrawal from the magazine 34, the successive mutual approaching of the legs 41*a* and 41*b* of the groove 39 of the second cam 40 again reverses the direction of rotation of the oscillating member about its shaft 21, position E, until it brings it back to its original radial disposition with respect to the shaft 4. In the foregoing device, the special configuration of the cams 23, 29 and 40, and their split action, one for the radial movement of the oscillating member and one for the rotation thereof about its respective axis of the shaft 21, affords a minimization of the angular size of those elements, as shown in FIG. 1, thereby enabling a larger number of labels to be picked up for a given size of the rotating drum comprising the plates 6 and 7. Furthermore, thanks to the rack 33, the cams 28, 29 and 40 also serve as guides and not as biassing elements for the oscillating members. This reflects in less stresses being imposed, such as would occur, for instance, in overcoming the dead centers. A further advantage connected with the use of the rack 33 resides in the elimination of relative movements or slip between the cylindrical segment 24 of the withdrawal segment 22 and the label, the rolling of one upon the other being rigidly guided by the gear segment 31 meshing with the rack 33 itself.

The invention is susceptible to many variations, according to the type of sheets or labels contained in the magazine; thus, for example, to pick up the sheets, rather than utilizing the adhesive power of the glue coating on the cylindrical segments 24, sucker members connected to a suction pump, or grippers, may be provided.

I claim:

1. A device for picking up sheets from a sheet magazine comprising a base, a shaft journalled in said base at a given distance from the leading sheet in said magazine and driven with continuous motion, a plate member fixed to said shaft, a plurality of withdrawal sectors oscillating supported on said plate member and each comprising a cylindrical sheet holding segment having a radius of curvature equal to said given distance and a gear segment extending in the same plane of said cylindrical segment, a stationary rack fixed in the same plane as the leading sheet and so as to intermesh with said gear segment, cam control means formed in the base and extending around said shaft and operatively associated with said sectors to pivot the latter, wherein according to the improvement the device further comprises a plurality of levers pivotally supported on said plate member and extending substantially circumferentially with respect to said shaft, each lever rotatably supporting a respective sector and the axes of rotation of said sectors and levers being parallel to said shaft, stationary cam means being further provided controlling pivoting movement of said levers to produce, in cooperation with said cam control means, rolling of said cylindrical segments onto the leading sheet with said gear segment in intermeshing relationship with said rack.

2. A device as claimed in claim 1 wherein said cam control means comprises a guide groove extending concentrically about said shaft for an angle greater than 180° and bifurcating into two crossing branches in front of the magazine and wherein in each lever a shaft is rotatably supported having an upper and a lower portion extending upwardly and downwardly from said lever, said shaft carrying attached to the upper portion a cylindrical segment and to the lower portion a gear segment and a pair of Y-shaped arms radially projecting from said shaft and supporting respective pins engaging said guide groove.

* * * * *